US006840178B2

(12) United States Patent
Collins et al.

(10) Patent No.: US 6,840,178 B2
(45) Date of Patent: Jan. 11, 2005

(54) SHAPED CHARGE LINER

(75) Inventors: William R. Collins, Mansfield, TX (US); Girven R. Kissell, Midlothian, TX (US); Matthew C. Clay, Ft. Worth, TX (US)

(73) Assignee: Titan Specialties, Ltd., Pampa, TX (US)

( * ) Notice: Subject to any disclaimer, the term of this patent is extended or adjusted under 35 U.S.C. 154(b) by 0 days.

(21) Appl. No.: 10/371,289

(22) Filed: Feb. 21, 2003

(65) Prior Publication Data

US 2004/0200377 A1 Oct. 14, 2004

(51) Int. Cl.[7] ..... F42B 10/00
(52) U.S. Cl. ..... 102/476; 102/307
(58) Field of Search ..... 102/476, 306, 102/307, 309

(56) References Cited

U.S. PATENT DOCUMENTS

| | | | | | |
|---|---|---|---|---|---|
| 2,856,850 | A | * | 10/1958 | Church et al. | 102/307 |
| 3,478,685 | A | * | 11/1969 | Thomanek et al. | 102/306 |
| 4,436,033 | A | * | 3/1984 | Precoul | 102/307 |
| 4,499,830 | A | | 2/1985 | Majerus et al. | |
| 4,537,132 | A | * | 8/1985 | Sabranski et al. | 102/307 |
| 4,672,896 | A | * | 6/1987 | Precoul et al. | 102/309 |
| 5,614,692 | A | * | 3/1997 | Brown et al. | 102/307 |
| 5,656,791 | A | | 8/1997 | Reese et al. | |
| 5,753,850 | A | | 5/1998 | Chawla et al. | |
| 5,792,977 | A | | 8/1998 | Chawla | |
| 6,012,392 | A | | 1/2000 | Norman et al. | |
| 6,021,714 | A | | 2/2000 | Grove et al. | |
| 6,305,289 | B1 | | 10/2001 | Mayseless et al. | |
| 6,349,649 | B1 | | 2/2002 | Jacoby et al. | |
| 6,378,438 | B1 | | 4/2002 | Lussier et al. | |
| 2003/0183113 | A1 | * | 10/2003 | Barlow et al. | 102/476 |

FOREIGN PATENT DOCUMENTS

WO WO 99/01713 * 1/1999

* cited by examiner

*Primary Examiner*—Jack Keith
*Assistant Examiner*—M. Thomson
(74) *Attorney, Agent, or Firm*—W. Allen Marcontell

(57) ABSTRACT

A liner for an explosive shaped charge is formed from a mixture of powdered metals into three or more conical sections wherein the axial height of the first two sections is 30% to 70% of the total liner height. The first conical section may be formed to an included angle of about 20° to about 60°. The second conical section is formed to a greater included angle of about 30° to about 70°. The third conical section is formed to a density less than that of the first and second section and to an included angle that is preferably greater than the first section and equal to or less than the second section.

20 Claims, 2 Drawing Sheets

α≈20°→60°
β≈30°→70°
θ≈30°→70°

β≥α
θ>α
θ≤β

SHAPED CHARGE LINER

BACKGROUND OF THE INVENTION

1. Field of the Invention

The invention generally relates to shaped charges of explosive material. More particularly, the invention relates to shaped charges designed primarily for perforating subterranean well casings and formations.

2. Description of Related Art

In the normal course of completing a subterranean well for the production of valuable fluids and/or minerals, a steel pipe casing is secured within the raw well borehole by a surrounding annulus of cement. Along the length of the casing, within the desired geologic production zone, the casing, the cement annulus and the production zone formation are perforated to provide fluid flow channels from the formation structure into the casing bore.

There are many variations to this theme which also includes open-hole and sand pack completions wherein there is no casing along the production zone in need of perforation. In any case, the formation zone is artificially fractured to induce drainage of fluid trapped within the formation interstices. Although there are several method options for well perforation, explosive perforation by means of shaped charges may be the most widely used.

A shaped charge is a relatively small module of highly explosive material that is encapsulated and geometrically configured to release a substantially linear plasma or jet of high temperature energy upon detonation. A plurality of these modules are secured within an elongated, generally cylindrical perforating "gun". The charges are usually distributed along the length of the gun and aligned to discharge radially outward from the cylinder axis along a substantially radial discharge axis.

In general, a shaped charge comprises a cup-like outer case of high strength material such as steel to serve as a containment vessel for focusing the energy discharge along a line emanating from the case. The explosive material is formed within the case. The outer surface of the explosive material is formed to a normal axis concavity and the concavity faced or clad with a "liner". Usually the liner is a thin section of relatively heavy metal such as brass, copper, lead etc, As the ignited explosive decomposes around the concavity, the liner material is radially compressed by immense pressure to be ejected as a fluidized plasma along the cavity axis of revolution.

The geometry of this concavity and properties of the liner are critical to the penetration performance of the shaped charge. Accordingly, an object of the present invention is a shaped charge having substantially improved efficiency, material penetration depth and hole diameter.

SUMMARY OF THE INVENTION

The present shaped charge liner comprises three or more substantially conical sections in axial alignment. Although described as substantially conical sections, frustums of other curvilinear shapes may be substituted to approximate the desired result.

The liner composition is preferably a mixture of powdered metals, including but not limited to copper and lead. Other powdered metals may be included or substituted such as brass, bismuth, tin, zinc, silver, antimony, cobalt, nickel, tungsten, uranium or other malleable, ductile metals. The liner may also contain plastics or polymers. The liner may be "restruck" to control density and/or sintered. The liner may also be machined, molded, stamped or laminated from solid or cast forms of the same metals, alloys and plastics.

The first section of the liner spreads from an approximate apex that may be pointed, flat, radiused, angled, or a hole. The conical spread angle preferably ranges from about 20° to about 60°. Considering the liner wall thickness, the outer wall surface of the first liner section may be parallel with the inner wall surface or differ by about 10°.

The second liner section is axially aligned with the first and is given a faired surface transition from top of the first section to the bottom of the second section. The included conical angles of the second section respective to the inner and outer wall surfaces may range from about 30° to about 70°. An approximately 10° differential may be accommodated between the inner and outer surfaces. The wall transition between the first and second sections may be angular with breakover edges respective to the inner and outer surfaces being in the same or different planes. Alternatively, the wall surface transitions may be mutually radiused.

The inner and outer wall surfaces of the third liner section may range from about 30° to about 70° and differ by about 20°. Preferably, the included conical angles of the third section are greater than those of the first section and equal or less than those of the second section. The wall transition between the second and third sections may be angular with breakover edges respective to the inner and outer surfaces being in the same or different planes. Alternatively, the wall surface transitions may be mutually radiused. The density of the third section may preferably be less that that of the first and second sections.

Regarding relative axial heights of the several conical sections, the sum of the heights of the first two sections is preferably about 30% to about 70% of the total height of all three conical sections.

BRIEF DESCRIPTION OF DRAWINGS

For a thorough understanding of the present invention, reference is made to the following detailed description of the preferred embodiments, taken in conjunction with the accompanying drawings in which like reference characters designate like or similar elements throughout the several figures of the drawing. Briefly.

DESCRIPTION OF THE PREFERRED EMBODIMENTS

Figure 1:
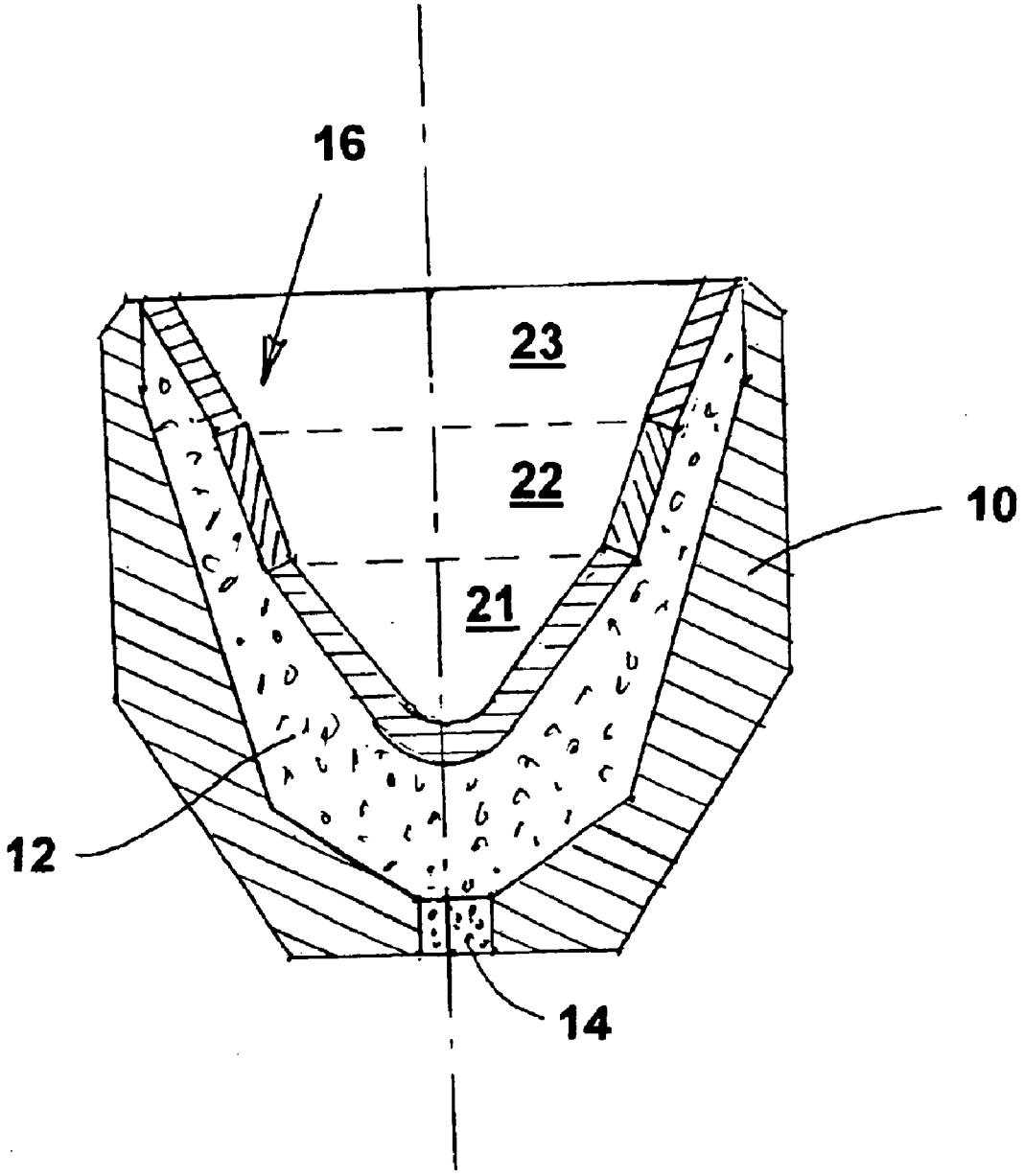
FIG. 1 is an axial cross-section of a representative shaped charge.

Referring to FIG. 1, a shaped charge for well pipe and formation perforation generally comprises an outer case 10 that serves as a containment vessel designed to hold the detonation force of the detonating explosive long enough for a perforating jet to form. Common materials used for the outer case 10 include steel, zinc, aluminum, ceramics and glass.

A main explosive charge 12 is contained inside the outer case 10 and integrally fills the space between the inside surface of the outer case and the external surface of a concave liner 16. A primer 14 may be initiated by a detonating chord (not shown), for example, which, in turn, initiates detonation of the main explosive charge 12.

The main explosive 12 may be one or a combination of compositions known in the art by trade designations such as HMX, HNS, RDX, PETN, PATB and HTX. The primer 14 is generally more sensitive explosive to provide an efficient detonation transfer from the detonating chord to the more stable high explosive 12.

The concave liner 16 of a typical shaped charge is internally open. When the explosive 12 is detonated, the force of the detonation collapses the liner 16 into the internal space and causes it to be ejected from the housing 10 as a very high velocity plasma jet.

The liner 16 of the present invention is preferably formed from a mixture of powdered metals such as copper and lead. Other powdered metals may be included or substituted such as brass, bismuth, tin, zinc, silver, antimony, cobalt, nickel, tungsten, uranium or other malleable, ductile metals in proportions and formulations known to the art. It is also known to include certain plastics or polymers in the mixture.

The powder mixture of the liner is usually consolidated in a high pressure forming press into the liner configuration. Subsequently, the initially pressed configuration may be sintered and/or "restruck" to achieve a desired density property. Although the present liner 16 is preferably formed from a mixture of powdered metals, those of ordinary skill will understand that the invention objectives may be served by a solid material form of metal alloy that is stamped, forged, machined, molded, layered or otherwise formed.

Figure 2:
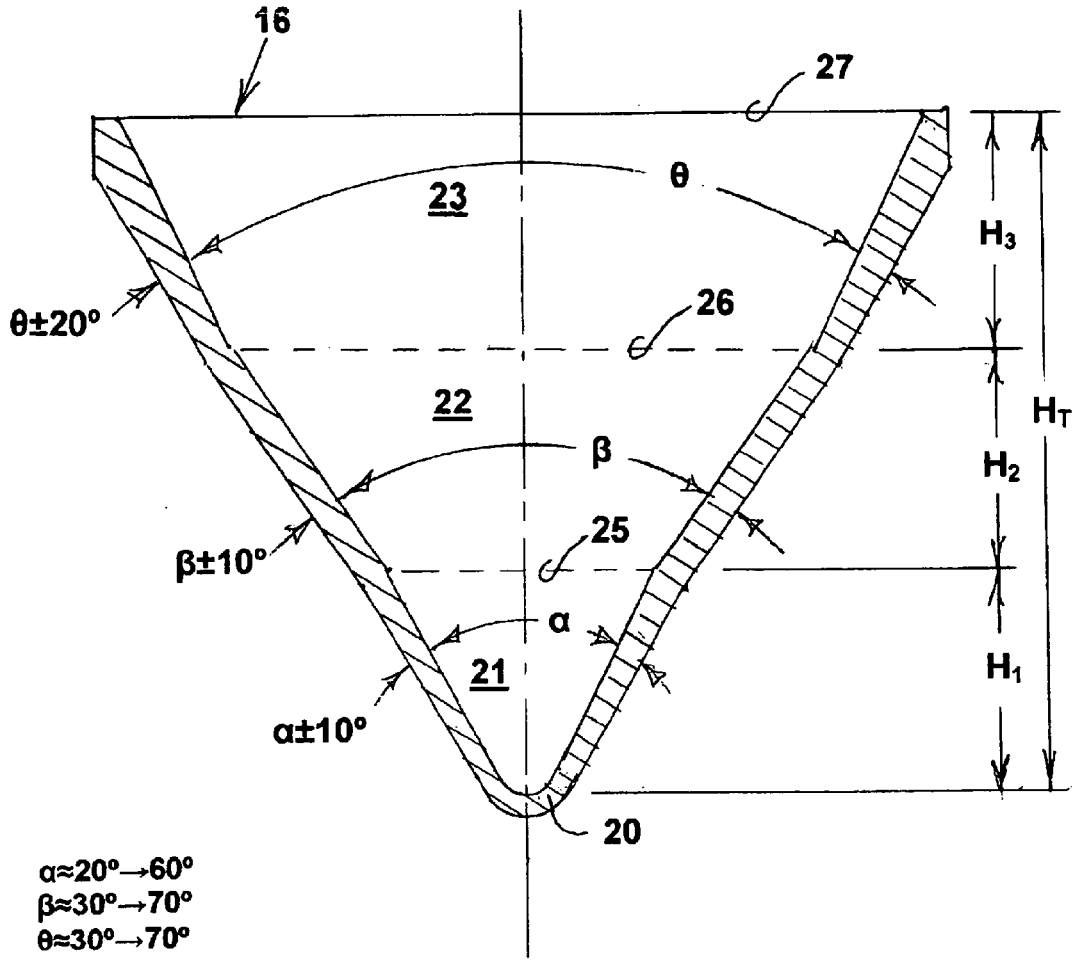
FIG. 2 is an enlarged detail of the present liner shown in axial cross-section.

With reference to FIG. 2, the liner 16 configuration selected for the present specification description is an integral composite of three or more generally conical sections 21, 22, and 23. The several conical sections are axially aligned with faired wall transitions at the contiguous interfaces 25 and 26. The descriptive term "axial alignment" is used herein and in the invention claims hereafter in the practical and general sense to mean that the axes of revolution respective to the several conical sections are within straight-line alignment to about ±0.005". Section 21, at the apex or bight of the liner concavity, is shown to be formed with a radiused tip 20. Alternatively, the first section tip 20 may be fiat, pointed, angled, or an aperture. The first section 21 side wall surfaces diverge conically from the tip 20 at an included angle $\alpha$ that ranges from about 20° to about 60°. 40° is a typical first section angle $\alpha$. The inside conical surface of the first liner section 21 may be parallel with the outside conical surface or diverge differentially up to about 10°.

The second liner section 22 is axially aligned with the first section but continues from a mutual interface 25 with a divergent wall formed to a greater conical angle $\beta$ of about 30° to about 70°. A substantially conical angle $\beta$ of about 52° is representative. The inside conical surface of the second liner section 22 may be parallel with the outside conical surface or diverge differentially up to about 10°.

The transition interface 25 between the first and second sections may be angular with inner and outer break edges being in the same plane or in slightly different planes. Alternatively, the transition may be radiused or otherwise faired and curvilinear.

The collective axial height, $H_1+H_2$, of the first two sections 21 and 22 is preferably about 30% to about 70% of the liner 16 total height, $H_T$. Conversely, the axial height $H_3$ of the third liner section 23 is about 30% to about 70% of the total liner height $H_T$.

Conical angles respective to the third section are preferably greater than those of the first section 21 but less than those of the second section 22. For example, the third section inside conical angle $\theta$ may be about 44°. Third section inside conical angles $\theta$ may range from about 30° to about 70°. The outside conical surface of the third section may be parallel with the inside surface or may diverge up to about 20°. The transition interface 26 between the second and third sections may be angular with inner and outer break edges being in the same plane or in slightly different planes. Alternatively, the transition may be radiused or otherwise faired and curvilinear. The outer or base edge 27 of the third section is preferably planar and normal to the liner axis 29.

Preferably, the density of the third section 23 is less than that of the first or second sections.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention. In particular, use of the terms "cone" and "conical section" herein and within the claims to follow is defined expansively to encompass curvilinear shapes and forms that are, generally, frusto-conical surfaces of revolution. Conical surfaces are generally defined as the surface generated by the revolution of a straight line about an intersecting, non-parallel, axis. The point of intersection between the axis and the line of revolution is generally characterized as the apex. The cone angle is generally defined as the angle rotated by the line of revolution about the apex from the axis. The "included" cone angle, (also described herein as the conical spread angle) is generally defined as twice the cone angle, or, the total angle between opposite cone surfaces. A frustum of a cone, described herein as "frusto-conical", is a cone segment between parallel planes that are normal (perpendicular) to the cone axis and are displaced from the apex. Hence, there is no mathematical apex within the volumetric envelope of a cone frustum.

We claim:

1. A shaped charge liner comprising at least three axially aligned, substantially frusto-conical sections formed by a mixture of compacted powdered metal, said sections having respective inner and outer substantially frusto-conical surfaces whereby inner and outer frusto-conical surfaces of a first section fairly transition into respective inner and outer frusto-conical surfaces of a second section and respective inner and outer frusto-conical surfaces of a second section fairly transition into inner and outer frusto-conical surfaces of a third section, a second conical angle respective to the inner frustoconical surface of said second section being greater than a first conical angle respective to the inner frusto-conical surface of said first section and a third conical angle respective to the inner frustoconical surface of said third section being less than said second conical angle but greater than said first conical angle.

2. A shaped charge liner as described by claim 1 wherein said first conical angle is about 20° to about 600.

3. A shaped charge liner as described by claim 1 wherein said second conical angle is about 30° to about 70°.

4. A shaped charge liner as described by claim 1 wherein said third conical angle is about 30° to about 70°.

5. A shaped charge liner as described by claim 1 wherein a fourth conical angle respective to the outer frusto-conical surface of said first section is up to about 10° greater than said first conical angle.

6. A shaped charge liner as described by claim 1 wherein a fifth conical angle respective to the outer frusto-conical surface of said second section is up to about 10° greater than said second conical angle.

7. A shaped charge liner as described by claim 1 wherein a sixth conical angle respective to the outer frusto-conical surface of said second section is up to about 20° greater than said third conical angle.

8. A shaped charge liner as described by claim 1 wherein a summation of an axial length respective to said first and second sections is about 30% to about 70% of a summation of an axial length of said first, second and third sections.

9. A shaped charge liner as described by claim 1 wherein said powdered metal mixture comprises copper and lead.

10. A shaped charge liner as described by claim 1 wherein said powdered metal mixture respective to said third section is less dense than said first or second sections.

11. A shaped charge assembly comprising a charge of highly explosive material that is intimately formed about a concave liner, said liner comprising a mixture of powdered metal that has been compacted to a consolidated configuration comprising at least three, axially aligned, substantially frusto-conical sections, said sections having respective inner and outer substantially frustoconical surfaces whereby inner and outer frusto-conical surfaces of a first section fairly transition into respective inner and outer frusto-conical surfaces of a second section and inner and outer frusto-conical surfaces of said second cone section fairly transition into respective inner and outer frusto-conical surfaces of a third section, a second conical angle respective to the inner frusto-conical surface of said second section being greater than a first conical angle respective to the inner frusto-conical surface of said first section and a third conical angle respective to the inner frustoconical surface of said third section being less than said second conical angle but greater than said first conical angle.

12. A shaped charge assembly as described by claim 11 wherein said first conical angle is about 20° to about 60°.

13. A shaped charge assembly as described by claim 1 wherein said second conical angle is about 30° to about 70°.

14. A shaped charge assembly as described by claim 1 wherein said third conical angle is about 30° to about 70°.

15. A shaped charge assembly as described by claim 11 wherein a fourth conical angle respective to the outer frusto-conical surface of said first section is up to about 10° greater than said first conical angle.

16. A shaped charge assembly as described by claim 11 wherein a fifth conical angle respective to the outer frusto-conical surface of said second section is up to about 10° greater than said second conical angle.

17. A shaped charge assembly as described by claim 11 wherein a sixth conical angle respective to the outer frusto-conical surface of said second section is up to about 20° greater than said third conical angle.

18. A shaped charge assembly as described by claim 11 wherein a summation of an axial length respective to said first and second sections is about 30% to about 70% summation of an axial length of said first, second and third sections.

19. A shaped charge assembly as described by claim 11 wherein said powdered metal mixture comprises copper and lead.

20. Charge assembly as described by claim 11 wherein the powdered metal mixture respective to said third section is compaction of said first or second sections.

* * * * *